United States Patent [19]

Fox

[11] 4,105,447

[45] Aug. 8, 1978

[54] PHOTOCONDUCTIVE INSULATING COMPOSITIONS INCLUDING POLYARYL HYDROCARBON PHOTOCONDUCTORS

[75] Inventor: Charles J. Fox, Rochester, N.Y.

[73] Assignee: Eastman Kodak Company, Rochester, N.Y.

[21] Appl. No.: 595,955

[22] Filed: Jul. 14, 1975

[51] Int. Cl.[2] ..... G03G 5/06; G03G 5/09

[52] U.S. Cl. ..... 96/1.6; 96/1.5 R

[58] Field of Search ..... 96/1.5, 1.6

[56] References Cited

U.S. PATENT DOCUMENTS

| | | | |
|---|---|---|---|
| 2,800,559 | 7/1957 | Ubbelohde | 96/1.5 X |
| 3,158,475 | 11/1964 | Cassiers et al. | 96/1.5 |
| 3,180,730 | 4/1965 | Klupfel et al. | 96/1.5 |
| 3,246,983 | 4/1966 | Sus et al. | 96/1.5 |
| 3,250,615 | 5/1966 | Van Allan et al. | 96/1.7 |
| 3,274,000 | 9/1966 | Noe et al. | 96/1.5 |
| 3,287,115 | 11/1966 | Hoegl | 96/1.5 |
| 3,331,687 | 7/1967 | Kosche | 96/1.5 |
| 3,351,591 | 11/1967 | Siegrist et al. | 96/1.5 X |
| 3,351,592 | 11/1967 | Siegrist et al. | 96/1.5 X |
| 3,408,183 | 10/1968 | Mammino | 96/1.5 |
| 3,567,450 | 3/1971 | Brantly | 96/1.5 |
| 3,634,078 | 1/1972 | Uhlig | 96/1.5 |
| 3,658,520 | 4/1972 | Brantly et al. | 96/1.5 X |
| 3,677,752 | 7/1972 | Looker et al. | 96/1.6 |
| 3,867,141 | 2/1975 | Bergford et al. | 96/1.5 |
| 3,923,506 | 12/1975 | Bergford et al. | 96/1.5 |
| 3,976,485 | 8/1976 | Grover | 96/1 PE X |

FOREIGN PATENT DOCUMENTS

| | | | |
|---|---|---|---|
| 41-18,467 | 10/1966 | Japan | 96/1.5 |
| 42-27,192 | 12/1967 | Japan | 96/1.5 |
| 1,016,072 | 1/1966 | United Kingdom | 252/62.1 L |

OTHER PUBLICATIONS

Hackl's Chemical Dictionary, 3rd Ed., 1944, pp. 33 and 78.

Gould, Inorganic Reactions and Structure, 1965, pp. 90–95.

McDaniel et al., "An Extended Table of Hammett Substituent Constants Based on the Jonigation of Substituted Benzoic Acids", Journal of Organic Chemistry, vol. 23, Mar. 1958, pp. 420–427.

Takasu et al., "Spectral Sensitization of Poly(N-vinylcarbagole) by Cyanine and Styryl Dyes", Journal of the Chemical Society of Japan, Chemistry and Industrial Chemistry, 1973, No. 1, Jan. pp. 29–34.

Hayashi et al., "Sensitization in the Photoconductance of Poly-N-vinylcarbazole", Bulletin of the Chemical Society of Japan, vol. 39, No. 8, 1966, pp. 1660–1670.

Morimoto et al., "Organic Photoconductive Layers Sensitized with Triarylcarbonium Salts", Applied Optics, Supplement 3: Electrophotography, 1969, pp. 50–54.

"Electrophotographic Contrast Control," No. 11610, Research Disclosure, Dec. 1973, pp. 19–22.

Kleimerman et al., "The Photoconductive and Emission Spectroscopic Properties of Organic Molecular Materials," Luminescence of Organic and Inorganic Materials, 1962, pp. 196–225.

Hoegl, "On Photoelectric Effects in Polymers and Their Sensitization by Dopants," Journal of Physical Chemistry, vol. 69, No. 3, Mar. 1965, pp. 755–766.

"Photoconductor Compositions," No. 11622, Research Disclosure, Dec. 1973, pp. 9–10.

Mai et al., "Relative Quantum Efficiencies of Some Ultraviolet Scintillators," Applied Optics, vol. 10, No. 1, Jan. 1971, pp. 207–208.

*Primary Examiner*—Roland E. Martin, Jr.

*Attorney, Agent, or Firm*—Ronald P. Hilst

[57] ABSTRACT

Polyaryl hydrocarbon photoconductors having the formula

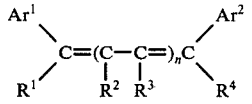

wherein:

$n$ is an integer having a value of 0 or 1;

$Ar^1$ and $Ar^2$ each represents an aryl group including substituted aryl such as an aryl group that is fused to other aromatic or nonaromatic ring systems; $R^1$, $R^2$, $R^3$ and $R^4$ each represents a hydrogen atom, an alkyl group or an aryl group including substituted aryl and, when $n$ is 1 and $R^1$ and $R^4$ are each hydrogen, $R^2$ and $R^3$ are each aryl; are combined with a sensitizer for the photoconductor and an electrically insulating binder to produce photoconductive compositions. Useful electrophotographic elements include a support having thereon such photoconductive insulating compositions.

14 Claims, No Drawings

PHOTOCONDUCTIVE INSULATING COMPOSITIONS INCLUDING POLYARYL HYDROCARBON PHOTOCONDUCTORS

FIELD OF THE INVENTION

This invention relates to electrophotography and in particular to photoconductive insulating compositions including polyaryl hydrocarbon photoconductors and to electrophotographic elements using such photoconductive compositions.

BACKGROUND OF THE INVENTION

The process of xerography, as disclosed by Carlson in U.S. Pat. No. 2,297,691, employs an electrophotographic element comprising a support material bearing a coating of an insulating material whose electrical resistance varies with the amount of incident electromagnetic radiation it receives, such as during an imagewise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner, whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor or the like, or transferred to a second element to which it can similarly be fixed. Likewise, the electrostatic charge pattern can be transferred to a second element and developed there.

Since the introduction of electrophotography, a great many organic compounds have been screened for their photoconductive properties. As a result, a very large number of organic compounds have been known to possess some degree of photoconductivity. Many organic compounds have revealed a useful level of photoconduction and have been incorporated into photoconductive compositions. Among these organic photoconductors are certain of the triphenylamines as described in U.S. Pat. No. 3,180,730 issued Apr. 27, 1965, and the polyarylalkane compounds such as those described in U.S. Pat. No. 3,274,000 issued Sept. 20, 1966; U.S. Pat. No. 3,542,547 issued Nov. 24, 1974; and in U.S. Pat. No. 3,615,402 issued Oct. 26, 1971. It has been a continuing objective to find new photoconductive materials and new photoconductive compositions.

Certain such materials, however, may exhibit photoconductivity only under certain circumstances, as when in single crystal form. In one such instance, Kleinerman et al, in an article entitled "The Photoconductive and Emission Spectroscopic Properties of Organic Materials" which was presented at the International Conference on Luminescence at the New York University on Oct. 10, 1961, reported that no photoconductivity was observed in a solid polystyrene solutions which contained 20 percent 1,1,4,4-tetraphenyl-1,3-butadiene, which is a good photoconductor in the pure crystalline state. The above is found on page 219 of the published proceedings of the Conference in the book Luminescence of Organic and Inorganic Materials, edited by Kallman and Spruch, John Wiley & Sons, Inc., New York, 1962.

SUMMARY OF THE INVENTION

It has been discovered, quite unexpectedly, that the inability of certain polyaryl hydrocarbon compounds, such as 1,1,4,4-tetraphenyl-1,3-butadiene, to demonstrate photoconductivity when distributed in an electrically insulating binder could be overcome by including with the photoconductor and binder a sensitizer for the photoconductor. Such sensitizers are preferably pyrylium dye salts and Lewis acids, as described more specifically hereinafter.

In accordance with the present invention photoconductive insulating compositions are provided which comprise (1) a photoconductor having the formula:

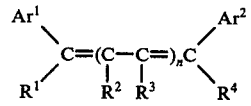

I.

wherein: $n$ is an integer having a value of 0 or 1;

$Ar^1$ and $Ar^2$ each represents an aryl group; $R^1$, $R^2$, $R^3$ and $R^4$ each represents a hydrogen atom, an alkyl group or an aryl group and when $n$ is 1 and $R^1$ and $R^4$ are hydrogen, $R^2$ and $R^3$ are aryl;

(2) an electrically insulating, polymeric binder (preferably non-interfering with respect to the photoconductor) and (3) a sensitizer for the photoconductor. Preferred sensitizers are pyrylium salt sensitizers and Lewis acids.

Such photoconductive insulating compositions can be coated as homogeneous solutions on electrically conducting support materials to provide useful electrophotographic elements that can be charged and imagewise exposed to yield electrostatic images. If desired, such elements can be developed by known techniques to yield visible images.

DESCRIPTION OF THE PREFERRED EMBODIMENTS

The present invention provides photoconductive insulating compositions including photoconductors of the formula

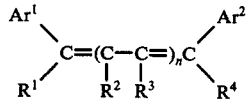

wherein $n$ is an integer having a value of 0 or 1;

$Ar^1$ and $Ar^2$ each represents a mono- or polycyclic aryl group such as phenyl or napthyl and including substituted aryl groups such as alkylphenyl, alkoxyphenyl and the like, preferably having from 1 to 10 carbon atoms in the alkyl or alkoxy moiety, e.g., methyl, ethyl, isopropyl, octyl, methoxy, ethoxy, amyloxy, heptoxy, etc. Additionally, other substituents that do not impair photoconductivity can be present on the aryl groups as part of the photoconductor molecule.

$R^1$, $R^2$, $R^3$ and $R^4$ each represents a hydrogen atom, a straight or branched chain alkyl group, preferably having from 1 to 10 carbon atoms in the named alkyl moiety, or an aryl group and, when $n$ is 1 and $R^1$ and $R^4$ are hydrogen, $R^2$ and $R^3$ are aryl.

Compounds within the group described herein and which are especially preferred for use in the present invention include 1,1,4,4-tetraphenyl-1,3-butadiene, 1,2,3,4-tetraphenyl-1,3-butadiene and tetraphenylethylene.

As mentioned previously, the photoconductors described herein are distributed in one or more electrically insulating binders. Useful binders include organic, film-forming, desirably hydrophobic, polymers having fairly high dielectric strength. Typically such binders include I. Natural resins including gelatin, cellulose ester derivatives such as alkyl esters of carboxylated cellulose, hydroxy ethyl cellulose, carboxy methyl cellulose, carboxy methyl hydroxy ethyl cellulose, etc.;

II. Vinyl resins including a. polyvinyl esters such as a vinyl acetate resin, a copolymer of vinyl acetate and crotonic acid, a copolymer of vinyl acetate with an ester of vinyl alcohol and a higher aliphatic carboxylic acid such as lauric acid or stearic acid, polyvinyl stearate, a copolymer of vinyl acetate and maleic acid, a poly(vinylhaloarylate) such as poly(vinyl-m-bromobenzoate-covinyl acetate), a terpolymer of vinyl butyral with vinyl alcohol and vinyl acetate, etc.;

b. vinyl chloride and vinylidene chloride polymers such as a poly(vinylchloride), a copolymer of vinyl chloride and vinyl isobutyl ether, a copolymer of vinylidene chloride and acrylonitrile, a terpolymer of vinyl chloride, vinyl acetate and vinyl alcohol, poly(vinylidene chloride) a terpolymer of vinyl chloride, vinyl acetate and maleic anhydride, a copolymer of vinyl chloride and vinyl acetate, etc.;

c. styrene polymers such as polystyrene, a nitrated polystyrene, a copolymer of styrene and monoisobutyl maleate, a copolymer of styrene with methacrylic acid, a copolymer of styrene and butadiene, a copolymer of dimethylitaconate and styrene, polymethylstyrene, etc.;

d. methacrylic acid ester polymers such as a poly(alkylmethacrylate), etc.;

e. polyolefins such as chlorinated polyethylene, chlorinated polypropylene, poly(isobutylene), etc.;

f. poly(vinyl acetals) such as poly(vinyl butyral), etc.; and g. poly(vinyl alcohol);

III. Polycondensates including a. a polyester of 1,3-disulfobenzene and 2,2-bis(4-hydroxyphenyl)propane;

b. a polyester of diphenyl-p,p'-disulphonic acid and 2,2-bis(4-hydroxyphenyl)propane;

c. a polyester of 4,4'-dicarboxyphenyl ether and 2,2-bis(4-hydroxyphenyl)propane;

d. a polyester of 2,2-bis(4-hydroxyphenyl)-propane and fumaric acid;

e. polyester of pentacrythritol and phthalic acid;

f. resinous terpene polybasic acid;

g. a polyester of phosphoric acid and hydroquinone;

h. polyphosphites;

i. polyester of neopentylglycol and isophthalic acid;

j. polycarbonates including polythiocarbonates such as the polycarbonate of 2,2-bis(4-hydroxyphenyl)-propane;

k. polyester of isophthalic acid, 2,2-bis[4-(β-hydroxyethoxy)phenyl]propane and ethylene glycol;

l. polyester of terephthalic acid, 2,2-bis[4-(β-hydroxyethoxy)phenyl]propane and ethylene glycol;

m. polyester of ethylene glycol, neopentyl, glycol, terephthalic acid and isophthalic acid;

n. polyamides;

o. ketone resins; and p. phenol-formaldehyde resins;

IV. Silicone resins

V. Alkyd resins including styrene-alkyd resins, silicone-alkyd resins, soya-alkyd resins, etc.;

VI. Polyamides;

VII. Paraffin; and

VIII. Mineral waxes.

Methods of making synthetic resins of such types have been described in publications, for example, styrene-alkyd resins can be prepared according to the method described in Gerhart U.S. Pat. No. 2,361,019 issued Oct. 24, 1944, and Rust U.S. Pat. No. 2,258,423 issued Oct. 7, 1941. Exemplary resins useful as binders in the photoconductive compositions described herein are sold under such tradenames as VITEL PE-101, CYMAC, Piccopale 100, Saran F-220, and LEXAN 145. Combinations of binders can be used where desirable.

Most preferably, the binders used in the compositions and elements of this invention are substantially non-interfering with respect to the photoconductor. By "non-interfering" is meant that the binder does not seriously impair the photoconductive response of a photoconductor/sensitizer combination. Such impairment is, of course, a relative matter, but for convenience reference to a formulation of known utility can be made. As an example, 1,1,4,4-tetraphenyl-1,3-butadiene can be codissolved with polystyrene and 2,6-bis(4-ethylphenyl)-4-(4-n-amyloxyphenyl)-thiapyrylium perchlorate in a weight ratio of 20:80:.8 for the photoconductor, binder and sensitizer respectively. Using procedures and calculations described hereinafter, an electrophotographic element using such composition has an electrical shoulder and toe speed, when charged positively to 600 volts and thereafter exposed to a Xenon lamp (5750° K), of 2000/80. By substituting equivalent amounts of other binders in the composition and using the same test procedures and calculations impairment in electrophotographic performance of the composition, based on the change in binder material, can be determined. Impairment of the photoconductor produces a decrease in the electrical shoulder and toe speeds.

In addition to the photoconductor and the binder, the photoconductive insulating compositions and electrophotographic elements of this invention include a compound that is a sensitizer for the photoconductor. Although the mechanism by which useful photoconductivity is imparted to such photoconductors when carried in an electrically insulating binder, in the presence of a suitable sensitizer, is not fully understood, it is believed that certain sensitizers, such as pyrylium salts, promote photoconductivity by providing a sensitization capability between photoconductor molecules.

Suitable sensitizers can be determined empirically, such as by preparing an electrophotographic element as described in Example 1 below, but substituting the sensitizer under consideration. The electrophotographic response of the element can then be tested, such as by charging, sensitometrically exposing and determining the resultant electrical speed. A wide range of sensitizers for consideration is described in Research Disclosure, Vol. 109, May 1973, No. 10938, particularly at Section IV C (p. 63). Particularly useful sensitizers are pyrylium dye salts, which, as used herein, designates collectively pyrylium dye salts, thiapyrylium dye salts and selenapyrylium dye salts, such as those disclosed in VanAllan et al U.S. Pat. No. 3,250,615 issued May 10, 1966. Exemplary such dye salts include 4-methoxy-2,6-diphenylpyrylium perchlorate
4-n-butylamino-2,6-diphenylthiapyrylium perchlorate
4-cyclohexylamino-2,6-diphenylthiapyrylium perchlorate
2,4,6-triphenylpyrylium perchlorate
6-(1-n-amyl-4-p-dimethylaminophenyl-1,3-butadienyl)-2,4-diphenylpyrylium fluoborate.
4-(4-amyloxyphenyl)-2,6-bis(4-methoxyphenyl)-pyrylium perchlorate.
4-(3,4-dichlorophenyl)-2,6-diphenylpyrylium perchlorate.
4-(4-methoxyphenyl)-2,6-diphenylpyrylium perchlorate.
2,4,6-triphenylpyrylium fluoborate.
6-(4-dimethylamino-β-ethylstyryl)-2,4-diphenylpyrylium fluoborate.
6-(α-ethyl-β,β-dimethylaminophenyl vinylene)-2,4-diphenylpyrylium fluoborate.
2,6-bis(4-ethylphenyl)-4-phenylpyrylium perchlorate.
2,4,6-triphenylthiapyrylium perchlorate.
4-(4-methoxyphenyl)-2,6-diphenylthiapyrylium perchlorate.
4-(2,4-dichlorophenyl)-2,6-diphenylthiapyrylium perchlorate.
4-(4-amyloxyphenyl)-2,6-bis(4-ethylphenyl)-thiapyrylium perchlorate.
2,4,6-triphenylthiapyrylium fluoborate.
2,4,6-triphenylthiapyrylium sulfate.
4-(4-methoxyphenyl)-2,6-diphenylthiapyrylium fluoborate.
2,4,6-triphenylthiapyrylium chloride.
2-[β,β-bis(4-dimethylaminophenyl)vinylene]-4,6-diphenylthiapyrylium perchlorate.
2,6-bis(4-ethylphenyl)-4-(4-methoxyphenyl)-thiapyrylium chloride.

Other preferred materials that demonstrate a sensitizing effect when used in combination with the photoconductors of this invention are Lewis acids. Exemplary such materials are described in U.S. Defensive Publication T881,002, dated Dec. 1, 1970; in U.S. Pat. No. 3,408,181 through 3,408,190, all dated Oct. 29, 1968; and in U.S. Pat. No. 3,418,116 dated Dec. 24, 1968. Preferred Lewis acids include such materials as 2,4,7-trinitrofluorenone and tetrachlorophthalic anhydride.

The photoconductive insulating compositions of this invention can be prepared by conventional techniques. Generally, the photoconductor, binder and sensitizer, as well as any other materials in the photoconductive composition are dissolved in a common solvent, producing a uniform distribution of its components. The amount of photoconductor used in preparing the photoconductive composition depends on the intended use. However, the amount of photoconductor is generally in the range of from about 1 to about 90% by weight of the photoconductive composition. For most applications, however, it is preferred that the amount of photoconductor present be in the range of at least about 10% – 15% by weight. The amount of sensitizer desirable in preparing photoconductive compositions of this invention depends on the particular sensitizer and photoconductor being used. Generally, amounts of sensitizer in the range of from about 0.001 to about 30% and typically from about 0.005 to about 10.0% by weight of the photoconductive composition will provide useful results, although greater or lesser quantities can be used, where appropriate.

Solvents useful for preparing coating compositions containing the photoconductors of the present invention can include a wide variety of organic solvents for the components of the coating composition.

Typical solvents include:

(1) Aromatic hydrocarbons such as benzene, naphthalene, etc., including substituted aromatic hydrocarbons such as toluene, xylene, mesitylene, etc.;
(2) Ketones such as acetone, 2-butanone, etc.;
(3) Halogenated aliphatic hydrocarbons such as methylene chloride, chloroform, ethylene chloride, etc.;
(4) Ethers including cyclic ethers such as tetrahydrofuran, ethyl ether;
(5) Mixtures of the above.

Suitable supporting materials on which can be coated photoconductive layers comprising the photoconductive compositions described herein include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum, electrically conducting metals intermixed with protective inorganic oxides, such as Cr with SiO (as described in U.S. Pat. No. 3,880,657) and the like coated on paper or conventional photographic film bases such as cellulose acetate, polystyrene, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 by Trevoy issued Apr. 12, 1966. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. No. 3,007,901 by Minsk issued Nov. 7, 1961, and 3,262,807 by Sterman et al issued July 26, 1966.

Coating can be accomplished by a wide variety of techniques, such as hopper coating and doctor blade coating.

Coating thickness of the photoconductive composition can vary widely. Normally, a coating in the range of about 10 microns to about 300 microns before drying is useful for the practice of this invention. The preferred range of coating thickness is found to be in the range from about 50 microns to about 150 microns before drying, although useful results can be obtained outside of this range. The resultant dry thickness of the coating is preferably between about 2 microns and about 50 microns, although useful results can be obtained with a dry coating thickness between about 1 and about 200 microns.

Photoconductive elements according to the present invention can be employed in any of the well-known electrophotographic processes which require photoconductive layers. One such process is the xerographic process. In a process of this type, an electrophotographic element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically-responsive particles having optical density. The developing electrostatically-responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush, toner applicator are described in the following U.S. Pat. Nos. 2,786,439 by Young issued Mar. 26, 1957; 2,786,440 by Giaimo issued Mar. 26, 1957; 2,786,441 by Young issued Mar. 26, 1957; 2,874,063 by Greig issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review" Vol. 15 (1954) pages 469–484.

The electrical resistivity of the photoconductive insulating element of the invention (as measured across the photoconductive insulating composition of the element in the absence of activating radiation for the composition) should be at least about $10^9$ ohm-cms. at 25° C. In general, it is advantageous to use elements having a resistivity several orders of magnitude higher than $10^{10}$ ohm-cms., for example, elements having an electrical resistivity greater than about $10^{14}$ ohm-cms. at 25° C.

The H & D electrical speeds described herein indicate the photoconductive response of electrophotographic materials and can be determined, for either shoulder (SH) or toe speed, as follows: The material is electrostatically charged under, for example, a corona source until the surface potential, as measured by an electrometer probe, reaches some suitable initial value $V_o$, typically about 600 volts. The charged element is then exposed to a 3000° K tungsten light source or a 5750° K Xenon light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the surface potential to any fixed selected value. The exposure in meter-candle-seconds required to reduce the initial surface potential $V_o$ to some value equal to $V_o$ minus 100. This is referred to as the 100 volt shoulder speed. If one wishes to determine the 100 volt toe speed, one merely uses the exposure in meter-candle-seconds required to reduce $V_o$ to an absolute value of 100 volts. An apparatus useful for determining the electrophotographic speeds of photoconductive compositions is described in Robinson et al, U.S. Pat. No. 3,449,658 issued June 10, 1969. The following examples are included to illustrate the present invention:

EXAMPLE 1

An electrophotographic element having a homogeneous photoconductive insulating layer was prepared by coating on a 0.004 inch electrically conducting polyethylene terephthalate support a solution having the following formulation:

| | | Parts (wt.) |
|---|---|---|
| Binder | Vitel PE-101X* | 9 |
| Solvent | Dichloromethane | 88 |
| Photoconductor | 1,1,4,4-tetraphenyl-1,3-butadiene (Eastman Organic Chemicals 7557) | 3 |
| Sensitizer | 2,4-di(4-ethoxyphenyl-6-(4-n-amyloxystyryl)pyrylium fluoroborate | 0.0375 |

*A copolyester from Goodyear Tire and Rubber Co.

In preparing the solution, the binder was first dissolved in the dichloromethane and to this solution was then added the photoconductor and thereafter the sensitizer, both accompanied by stirring. After the coated layer was dried, the resultant element was tested using procedures described herein and found to have a useful electrophotographic speed.

EXAMPLE 2

Electrophotographic elements were prepared in a similar manner to that of Example 1 with the coating solutions comprising various binders and 1,1,4,4-tetraphenyl-1,3-butadiene as the photoconductor. The photoconductor was used in the amount of 20% by weight of the photoconductor plus binder. Some of the elements were sensitized using 2,6-bis(4-ethylphenyl)-4-(4-n-amyloxyphenyl)thiapyrylium perchlorate in the amount of 0.8% by weight of the photoconductor plus binder. The remaining elements were not sensitized. After charging overall and exposing sensitometrically, the electrophotographic properties of these elements were measured with the results tabulated in Table I below.

TABLE I

| Binder | Sensitizer | Relative Electrical H + D Speeds Tungsten (Sh/100 V toe) + | Tungsten − | Xenon (Sh/100 V toe) + | Xenon − | Peak Absorption nm |
|---|---|---|---|---|---|---|
| polystyrene | absent | 0/0 (Vo=810) | 0/0 (Vo=730) | 0/0 (Vo=720) | 0/0 | 390 |
| polystyrene | present (0.8% | *100/2.7 | *100/0 | *100/4 | *100/3 | 440 |
| Lexan 145 | absent | 0/0 | 0/0 (Vo=740) | 0/0 | 0.8/0 (Vo= 730) | 385 |
| Lexan 145 | present (0.8%) | 150/5.8 | 160/4.5 | 225/7 | 167/7.5 | 445 |
| Vitel 101 | absent | 0/0 | 0/0 | 3/0 | 4.6/0 | 385 |
| Vitel 101 | present (0.8%) | 91.7/3.0 | 100/3.2 | 50/3.2 | 83/4 | 450 |
| polystyrene(80%) Vitel 101(20%) | absent | 0/0 | 0/0 | 1/0 (Vo=730) | 0/0 | 390 |
| polystyrene(80%) Vitel 101(20%) | present (0.8%) | 58/0 | 55/0 | 27.5/2 | 18.8/2.3 | 445 |
| poly(vinyl-m-bromobenzoate) | absent | 0/0 (Vo=370) | 0/0 | 0/0 | 0.5/0 | 385 |
| poly(vinyl-m-bromobenzoate) | present (0.8%) | 83/11.7 (Vo=370) | 100/7.0 | 80/8 (Vo=440) | 133/8.3 | 455 |

$V_o$ = 600 volts unless indicated in Table I
*arbitrarily assigned a value of 100 in each column As can be seen from the results in Table I, compositions of the invention, containing a sensitizer, produced electrophotographic elements exhibiting desirable electrophotographic speeds.

EXAMPLE 3

Electrophotographic elements were prepared in a similar manner to that of Example 1 using compositions containing a binder and a sensitizer. This time some of the elements contained 1,1,4,4-tetraphenyl-1,3-butadiene as the photoconductor at a concentration of 20% by weight of the binder plus photoconductor. The remaining elements contained no photoconductor. The electrophotographic properties of these elements, measured using a $V_o$ of 600 volts and exposure to a Xenon 5750° K light, are tabulated below in Table II wherein sensitizer I is 2,4,6-triphenylpyrylium fluoroborate, II is 2,4-bis(4-ethoxyphenyl)-6-(4-amyloxystyryl)-pyrylium fluoroborate, and III is tetrachlorophthalic anhydride, a Lewis acid.

The sensitizer is present in an amount of 0.8% by weight of the photoconductor plus binder.

TABLE II

| Binder | Photo-Conductor | Sensitizer | Relative Electrical H+D Speed Sh/100 Volt Toe + | − |
|---|---|---|---|---|
| polystyrene | absent | I | *100/0 | *100/0 |
| polystyrene | present | I | 2800/400 | 2250/160 |
| polystyrene | absent | II | 0/0 | 0/0 |
| polystyrene | present | II | 1280/0 | 1600/0 |

TABLE II-continued

| Binder | Photo-Conductor | Sensitizer | Relative Electrical H+D Speed Sh/100 Volt Toe + | − |
|---|---|---|---|---|
| polystyrene | absent | III | 0/0 | 0/0 |
| polystyrene | present | III | 1800/100 | 600/0 |
| Lexan 145 | absent | I | 0/0 | 0/0 |
| Lexan 145 | present | I | 32000/1280 | 10,000/500 |
| Lexan 145 | absent | II | 36/0 | 0/0 |
| Lexan 145 | present | II | 4000/200 | 4000/110 |
| Lexan 145 | absent | III | 0/0 | 0/0 |
| Lexan 145 | present | III | 3200/144 | 1100/0 |

*Arbitrarily assigned a value of 100 in each column.

As can be readily seen from the examples, the electrophotographic properties of the compositions of the present invention are a result of the particular photoconductors of this invention in combination with a sensitizer.

EXAMPLE 4

Using the procedure described in Example 1, electrophotographic elements were prepared comprising various binders, 1,1,4,4-tetraphenylbutadiene as the photoconductor and the Lewis acid, 2,4,7-trinitrofluorenone, as the sensitizer. The photoconductor was used in the amount of 20% by weight of the photoconductor plus binder and the sensitizer was used in the amount of 10% by weight of the photoconductor plus binder. After charging overall and exposing sensitometrically, the electrophotographic properties of these elements were measured with the results tabulated in Table III below.

TABLE III

| Binder | Photoconductor | Sensitizer | Relative Electrical H+D Speeds Tungsten (Sh/100 V Toe) + | Tungsten − | Xenon (Sh/100 V Toe) + | Xenon − |
|---|---|---|---|---|---|---|
| Vitel 101 | absent | present | *100/0 | *100/0 | *100/4.6 | *100/6 |
| Vitel 101 | present | present | 500/20 | 625/22.5 | 728/50 | 392/28 |
| Polystyrene | absent | present | 28/0 | 22.5/0 | 255/0 | 78/0 |
| Polystyrene | present | present | 278/0 | 312.5/0 | 728/36 | 112/7.8 |

*Arbitrarily assigned a value of 100 in each column

The invention has been described in detail with particular reference to the preferred embodiment thereof, but it is understood that variations and modifications can be effected within the spirit and scope of the invention.

There is claimed:

1. A photoconductive insulating composition comprising an admixture of an electrically insulating polymeric binder, a photoconductor having the formula

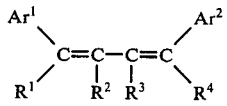

wherein $Ar^1$ and $Ar^2$, which can be the same or different, each represents a phenyl or a naphthyl group which is unsubstituted or substituted with alkyl or alkoxy having 1 to 10 carbon atoms; $R^1$, $R^2$, $R^3$ and $R^4$, which can be the same or different, each represents a hydrogen atom, an alkyl group having 1 to 10 carbon atoms or a phenyl group and, when both $R^1$ and $R^4$ are hydrogen, both $R^2$ and $R^3$ are phenyl groups, and from about 0.001 to about 30% by weight of the total composition weight of a sensitizer for the photoconductor selected from the group consisting of a pyrylium dye salt and a Lewis acid.

2. The photoconductive insulating composition of claim 1 wherein the sensitizer is a pyrylium dye salt.

3. The photoconductive insulating composition of claim 1 wherein the sensitizer is a Lewis acid.

4. The photoconductive insulating composition of claim 1 wherein the binder is substantially non-interfering with respect to the photoconductor.

5. The photoconductive insulating composition of claim 1 wherein the photoconductor is selected from the group consisting of 1,1,4,4-tetraphenyl-1,3-butadiene and 1,2,3,4-tetraphenyl-1,3-butadiene.

6. The photoconductive insulating composition of claim 1 wherein the photoconductor is 1,1,4,4-tetraphenyl-1,3-butadiene.

7. The photoconductive insulating composition of claim 6 wherein the sensitizer is selected from the group consisting of 2,4-di(4-ethoxyphenyl)-6-(4-n-amyloxystyryl)-pyrylium fluoroborate, 2,6-bis(4-ethylphenyl)-4-(4-n-amyloxyphenyl)-thiapyrylium perchlorate, 2,4,6-triphenylpyrylium fluoroborate, tetrachlorophthalic anhydride, and 2,4,7-trinitrofluorenone.

8. An electrophotographic element comprising an electrically conductive support having thereon a photoconductive insulating composition as described in claim 1.

9. An electrophotographic element comprising an electrically conductive support having thereon a photoconductive insulating composition as described in claim 2.

10. An electrophotographic element comprising an electrically conductive support having thereon a photoconductive insulating composition as described in claim 3.

11. An electrophotographic element comprising an electrically conductive support having thereon a photoconductive insulating composition as described in claim 4.

12. An electrophotographic element comprising an electrically conductive support having thereon a photoconductive insulating composition as described in claim 6.

13. An electrophotographic element comprising an electrically conductive support having thereon a photoconductive insulating composition as described in claim 7.

14. A photoconductive insulating composition comprising a mixture of an electrically insulating polymeric binder, a photoconductor having the formula

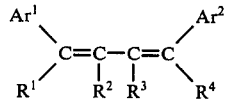

wherein $Ar^1$ and $Ar^2$, which can be the same or different, each represents a phenyl or a naphthyl group; $R^1$, $R^2$, $R^3$ and $R^4$, which can be the same or different, each represents a hydrogen atom or a phenyl group, and, when both $R^1$ and $R^4$ are hydrogen, both $R^2$ and $R^3$ are phenyl groups, and from about 0.001 to about 30% by weight of the total composition weight of a sensitizer for the photoconductor selected from the group consisting of a pyrylium dye salt and a Lewis acid.

* * * * *